US006462014B1

(12) United States Patent
Johnson et al.

(10) Patent No.: US 6,462,014 B1
(45) Date of Patent: Oct. 8, 2002

(54) LOW FOAMING/DEFOAMING COMPOSITIONS CONTAINING ALKOXYLATED QUATERNARY AMMONIUM COMPOUNDS

(75) Inventors: Andress K. Johnson, Pleasantville, NY (US); Ralph Franklin, Danbury, CT (US)

(73) Assignee: Akzo Nobel N.V., Arnhem (NL)

( * ) Notice: Subject to any disclaimer, the term of this patent is extended or adjusted under 35 U.S.C. 154(b) by 29 days.

(21) Appl. No.: 09/829,257

(22) Filed: Apr. 9, 2001

(51) Int. Cl.[7] ..... C11D 1/835; C11D 1/62; C11D 1/72

(52) U.S. Cl. ..... 510/504; 510/237; 510/238; 510/362; 510/384; 510/391; 510/421; 510/356; 510/329; 510/289

(58) Field of Search ..... 510/237, 238, 510/362, 384, 391, 421, 504, 356, 329, 289

(56) References Cited

U.S. PATENT DOCUMENTS

| | | | | | |
|---|---|---|---|---|---|
| 4,347,168 | A | * | 8/1982 | Murphy et al. | 252/547 |
| 5,522,942 | A | | 6/1996 | Graubart et al. | 134/40 |
| 5,693,591 | A | | 12/1997 | North et al. | 504/116 |
| 5,750,733 | A | * | 5/1998 | Vermeer et al. | 549/346 |
| 5,885,932 | A | | 3/1999 | Parr et al. | 504/116 |
| 6,136,769 | A | * | 10/2000 | Asano et al. | 510/329 |
| 6,187,737 | B1 | | 2/2001 | Geke et al. | 510/245 |
| 6,274,538 | B1 | * | 8/2001 | Addison | 510/224 |
| 6,303,561 | B1 | * | 10/2001 | Painter | 510/446 |

FOREIGN PATENT DOCUMENTS

| | | | | |
|---|---|---|---|---|
| CA | 1337586 | A1 | 11/1995 | B01F/17/00 |
| DE | 4322571 | A1 | 7/1994 | B01F/17/18 |
| DE | 19824685 | A1 | 12/1999 | A61K/7/135 |
| EP | 0090117 | A1 | 10/1983 | C07C/93/04 |
| EP | 0199403 | A2 | 10/1986 | C11D/1/83 |
| EP | 0450706 | A1 | 10/1991 | C07C/217/08 |
| EP | 0791556 | A1 | 8/1997 | C01B/33/44 |
| EP | 869114 | A1 | 10/1998 | C07C/219/06 |
| GB | 2334723 | A1 | 9/1999 | C11D/1/65 |
| WO | WO87/0250 | A1 | 4/1987 | C11D/1/44 |
| WO | WO9744433 | A1 | 11/1997 | C11D/3/39 |
| WO | WO9845394 | | 10/1998 | C11D/3/00 |
| WO | WO9955634 | A1 | 11/1999 | C04B/28/02 |

OTHER PUBLICATIONS

Abstract for Japanese Patent No.: JP0322791A2.
Chemical Abstract for German Patent No.: DE19824685 A1.
Chemical Abstract for German Patent No.: DE4322571–A1.

* cited by examiner

*Primary Examiner*—Charles Boyer
(74) *Attorney, Agent, or Firm*—Ralph J. Mancini

(57) ABSTRACT

The present invention generally relates to low foaming and/or defoaming cleaning formulations which, comprises a synergistic combination of one or more hydrotropic alkoxylated quaternary ammonium compounds and at least one nonionic surfactant based on branched alcohols. The nonionic surfactant may be selected from structures having 3 to 12 moles of ethoxylation, but preferably have an average of 3–6 moles of ethoxylation with either narrow or broad range distribution.

22 Claims, 1 Drawing Sheet

Figure 1:
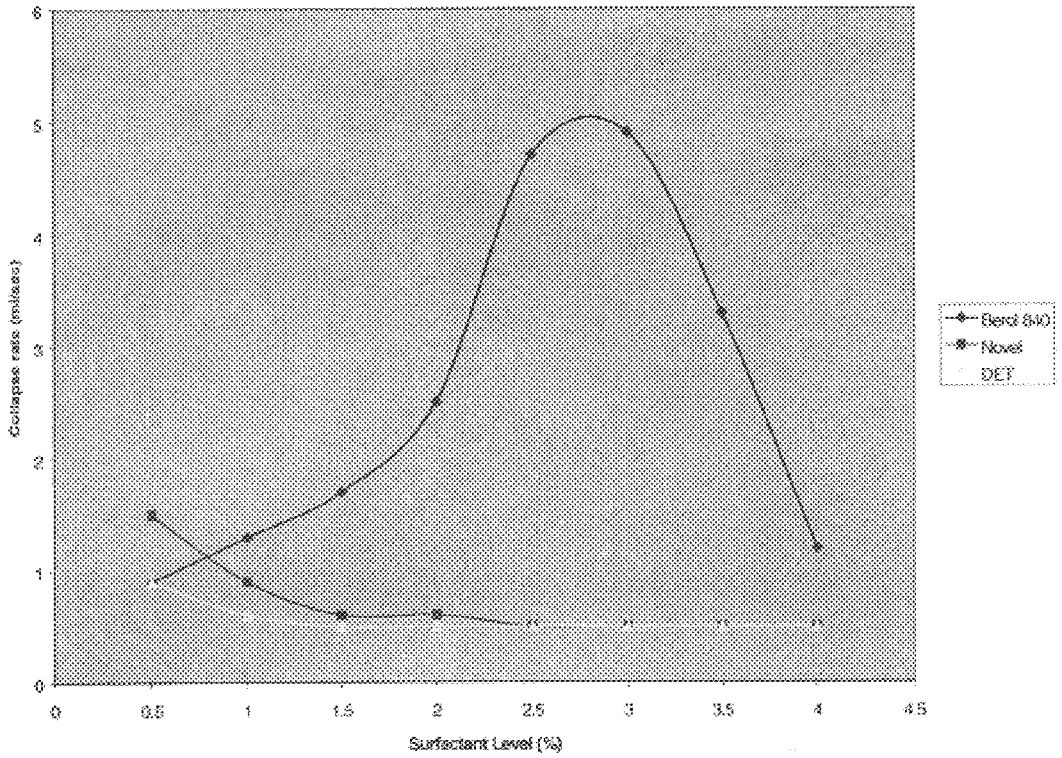

LOW FOAMING/DEFOAMING COMPOSITIONS CONTAINING ALKOXYLATED QUATERNARY AMMONIUM COMPOUNDS

FIELD OF THE INVENTION

This invention relates to cleaning applications that require low foam or non-foam cleaning formulations such as in automatic dishwashers, Cleaning in Place (CIP), automatic floor scrubbers, enclosed parts cleaning and the like. Any foam that is generated in these systems should be unstable and break down rapidly to prevent accumulation of foam during the process.

BACKGROUND OF THE INVENTION

Typical hard surface cleaning formulations consist of a nonionic surfactant or solvent component, an electrolyte component (chelates or builders) and a hydrotropic co-surfactant (amphoteric, anionic or cationic surfactants). Quaternary ammonium compounds can function as the hydrotropic co-surfactants.

In the cleaning industry there are several specialized categories of cleaning where foaming can be very detrimental to the application. Examples of such formulations include Cleaning In Place formulations, automatic floor scrubber formulations, automatic dishwasher formulations, re-circulatory metal parts cleaning and the like. These types of formulations demand low, fast breaking foams to avoid overflow, product loss, pump cavitation, and streaks/films on treated surfaces after drying. If the cleaning formulation shows any tendency to foam then the high turbulence caused by either brushes or water sprays will result in foam.

In order to address the foaming issues, formulators often add oils or silicon defoamers to reduce or eliminate foam. Often these additives leave films and deposits on the surface, resulting in a poorly cleaned surface. Secondly at high concentrations of alkaline salts, such as in aqueous concentrates in which typically the cleaning compositions are supplied to the end user, these additives are not soluble.

Formulators also use low foam or defoaming nonionic surfactants in these cleaning formulations to minimize foam. Examples include EO/PO block copolymers, branched alcohol ethoxylates, capped alcohol ethoxylates and the like. However, the addition of hydrotropes or hydrotropic co-surfactants that couple the electrolytic component and the low foam/defoam nonionic component together can result in foam stabilization, foam addition or foam boosting negating the effect of the low foaming or defoaming nonionic. This has resulted in many formulators avoiding the use of hydrotropes in their cleaning formulations. Additionally, these cleaning formulations have the lowest foam profile when the cleaning is done at temperatures above the formulations cloud points which results in cleaning solutions that are unstable and inefficient. Also, these formulations tend to have depletion problems especially in enclosed re-circulator systems. This requires that the nonionic surfactant be replenished in order to prevent flash foam occurrence.

The present invention has solved the deficiencies of the prior art by providing low foaming and/or defoaming formulations, which comprise an alkoxylated quaternary ammonium compound and at least one nonionic compound of a specific structure.

SUMMARY OF THE INVENTION

The present invention generally relates to low foaming and/or defoaming cleaning formulations which comprise a synergistic combination of one or more hydrotropic alkoxylated quaternary ammonium compounds and at least one nonionic surfactant based on branched alcohols. The nonionic surfactant may be selected from structures having 3 to 12 moles of ethoxylation, but preferably have an average of 3–6 moles of ethoxylation with either narrow or broad range distribution.

DETAILED DESCRIPTION OF THE INVENTION

The present invention generally relates to low foaming and/or defoaming cleaning formulations which comprise a synergistic combination of one or more hydrotropic alkoxylated quaternary ammonium compounds and at least one nonionic surfactant based on branched alcohols.

The hydrotropic alkoxylated quaternary ammonium compound is preferably selected from the group of compounds represented by General Formula I, below.

$$R_1R_2R_3R_4N^+X^- \quad \text{(I)}$$

wherein $R_1$ is a linear or branched, saturated or unsaturated $C_6$–$C_{22}$ alkyl group;

$R_2$ is $C_1$–$C_6$ alkyl group or $R_1$;

$R_3$ and $R_4$ are $C_2$–$C_4$ random or block polyoxyalkylene groups; and $X^-$ is an anion, preferably chloride, methyl sulfate, bromide, iodide, acetate, carbonate, and the like.

Preferred compounds within the scope of general Formula I are represented by General Formula II, below.

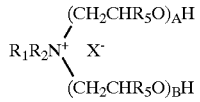

(II)

wherein $R_1$, $R_2$, and $X^-$ are as defined above;

each $R_5$ is independently at each occurrence $C_1$–$C_2$ alkyl or H, provided that $R_5$ is a $C_1$–$C_2$ alkyl in at least one occurrence; and A and B are integers greater than or equal to 1 wherein A+B is 2–50.

Most preferred hydrotropic quaternary ammonium compounds within the scope of the present invention are as shown below where R=linear or branched, saturated or unsaturated $C_{12}$–$C_{22}$ alkyl, n+n'=0–10, m+m'=1–20, y+y'=0–20, and $X^-$ is an anion, preferably chloride or methyl sulfate, provided that when n+n'=0, y+y' is at least 1.

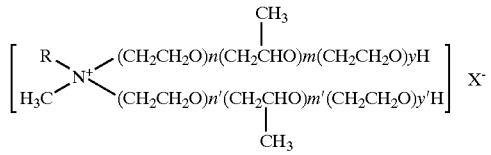

An especially preferred hydrotropic quaternary ammonium compound is Berol CHLF available from Akzo Nobel Surface Chemistry LLC, Chicago, Ill., USA:

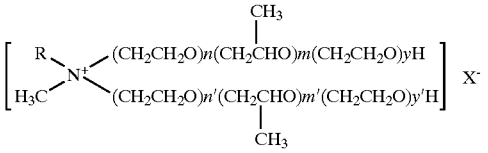

where R is tallow alkyl, n+n'=2, m+m'=12, y+y'=5 and X is methyl sulfate.

The quaternary ammonium compound described in this invention may be prepared by quaternization of the starting amino compound described below using known methods such as that described in U.S. Pat. No. 5,885,932 which is incorporated herein by reference. The fourth substituent added to the amino nitrogen by quaternization is preferably a group selected from alkyl, or alkenyl group having 1–4 carbons. Any suitable anion can be employed. Preferred anions include, but are not limited to, a member selected from the group consisting essentially of methyl sulphate, carbonate, chloride, fluoride, bromide, acetate and the like.

The starting amino group can be prepared by reacting an amine selected from the group consisting of $R_1$—$NH_2$ and $R_1R_2NH$ wherein $R_1$ and $R_2$ as in structure (I); with at least one propylene oxide and at least one alkylene oxide. Preferred alkylene oxides include but are not limited to ethylene oxide, propylene oxide, isobutylene oxide, butylene oxide and mixtures thereof. The compounds of the present invention are made in such a way as to introduce varying numbers of alkylene oxide units onto the amino nitrogen. The additional alkylene oxide groups may be all the same, such as, for example, one or more ethylene oxide units, or the groups may be different to form, for example, block copolymer chains of ethylene oxide and propylene oxide units, random copolymer chains consisting of several units of each of two or more different alkylene oxides, or alternating units of two or more alkylene oxides. Any conceivable combination of alkylene oxide units up to 50 units long may be employed at each available location on the amino nitrogen. For example, the amino nitrogen may contain two different alkylene oxide chains attached thereto or two chains that are the same.

In a preferred embodiment, block copolymer chains of ethylene oxide and one or more of propylene oxide or butylene oxide are employed. Preferably, the molar weight of the compounds used in the present invention is less than 8000 though higher molecular weight compounds can be employed. Typical compounds suitable for use in the present invention include, but are not limited to, bis(hydroxyethyl) methyltallow alkyl, ethoxylated, propoxylated, methyl sulphate; cocobis(2-hydroxyalkyl)methylammonium chloride; polyoxyalkylene (15) cocomethylammonium chloride; oleylbis(2-hydroxyalkyl)methyl ammonium chloride; polyoxyalkylene (15) stearylmethyl ammonium chloride; N,N-bis(2-hydroxyalkyl)-N-methyloctadecanaminium chloride; N-tallowalkyl-N,N'-dimethyl-N-N'-polyalkyleneglycol-propylenebis-ammonium-bis methylsulphate; polyoxyalkylene (3) tallow propylenedimonium dimethylsulphate; coconut penta-alkoxy methyl ammonium methyl sulphate; polyoxyalkylene (15) cocomonium methosulphate; isodecylpropyl dihydroxyalkyl methyl ammonium chloride; isotridecylpropyl dihydroxyalkyl methyl ammonium chloride; methyl dihydroxyalkyl isoarachidaloxypropyl ammonium chloride; and mixtures thereof.

The nonionic surfactant employed in the context of the present invention is preferably selected from the group of compounds represented by General Formula III, below $$R—O—(CH_2CH_2O)_nH \qquad III$$

wherein R is a branched alkyl group with 3–12 carbon atoms, preferably a Guerbet alcohol type with 10 carbon atoms or less and/or mixtures thereof, and n=3–12, but preferably 3–6 moles of ethoxylation with either narrow or broad range distribution. Specific examples of nonionic surfactants employable in the context of the present invention include but are not limited to:

polyoxyethylene (3) 2-ethylhexanol, polyethyleneglycol-4 ethylhexyl ether, polyethyleneglycol-5 ethylhexanol, polyoxyethylene (4) 2-ethylheptyl, polyoxyethylene (5) isodecanol and polyoxyethylene (5) 2-propylhepanol.

The formulation of the invention generally contains from about 0.1% to about 12% by weight nonionic surfactant, preferably from about 1% to about 8% and still more preferably from about 2% to about 4%. The present formulation also preferably contains, in combination with said nonionic compound, from about 1% to about 20% by weight alkoxylated quaternary ammonium compound, preferably between 2% to about 10%, and still more preferably between about 4% and about 8%. This synergistic combination of one or more hydrotropic alkoxylated quaternary ammonium compounds and at least one nonionic surfactant based on branched alcohols produces a clear and stable cleaning formulation, with unusual foam collapse properties in the presence of typical cleaning additives such as NaOH, EDTA, TKPP, glycols, corrosion inhibitors, phosphonates, solvents, carbonates, borates, citrates, acids, silicates and the like.

The low foaming/defoaming cleaning compositions of the present invention are ideal for applications that demand low, fast breaking foams to avoid overflow, product loss, pump cavitation, and streaks or films on treated surfaces after drying. Several specialized categories of cleaning which meet this criteria include but are not limited to Cleaning In Place formulations, automatic floor scrubber formulations, automatic dishwasher formulations, re-circulatory metal parts cleaning formulations and the like.

The specialized cleaning formulations of the invention may also be formulated with ingredients know in the art. As nonlimiting examples, such formulations may include hydrotropes or coupling agents, surfactants, thickening agents, chelating agents, builders, defoamers and anti-foam agents, corrosion inhibitors and the like.

Hydrotropes or coupling agents include but are not limited to glycol ethers, alcohols, acrylic polymers, sodium xylene sulphonate, phosphate esters, amphoteric surfactants, alkoxylated carboxylates, aminopropionates, glycerine, alkylpolyglucosides, alkanolamides, quaternary ammonium compounds or mixtures thereof.

Surfactants, include but are not limited to, amphoteric, cationic, nonionic, anionic classes and mixture thereof.

Thickening agents include, but are not limited to, associative polymers and copolymers, acrylic polymers, amides, xanthan gums, cellulosic polymers, modified clays, amine oxides, ethoxylates amines, silica, silicates, polyvinyl pyrrolidone and mixtures thereof.

The electrolytic components can consist of chelating agents or builders. Chelating agents include but are not limited to gluconates, citric acid, sodium ethylenediaminetetraacetic acid, phosphonates, phosphoric acids, phosphates, polyphosphates, nitrotriacetic acid, ethylenediaminebis(2-hydroxyphenylacetic acid) and mixtures thereof. Builders include, but are not limited to soda ash, acrylic polymers, silicates, phophonates, phosphates, carbonates, citrates, sodium hydroxide, potassium hydroxide, triethanolamine and mixture thereof.

Corrosion inhibitors include but are not limited to alkanolamides, aliphatic carboxylic acids, amides, amines, diamines, polyamines, phosphoric acid, borates, oxazolines, phosphate esters, benzotriazole, azoles, imidazolines, amphoteric surfactants, silicates, phophonates, gluconates, fatty acids, thioazoles and mixtures thereof.

Other optional components may be included in the formulations of the present invention. These include but are not limited to liquid carriers such as water, pH modifiers, enzymes, bleaching agents, bleach activators, optical brighteners, soil release agents, antistatic agents, lubricants, preservatives, perfumes, colorants, anti-redeposition agents, dispersing agents, acidifying agents and solvents.

The invention will now be illustrated by the following nonlimiting examples. The following chemicals were utilized in the examples and their identities are provided below.

From Akzo Nobel Surface Chemistry LLC.

- Berol® 260—$C_{9-11}$ alcohol with 4 moles of ethoxylation (narrow range)
- Berol® 840—2-ethylhexyl with 4 moles of ethoxylation (narrow range)
- Berol OX-91-4—$C_{9-11}$ alcohol with 4 moles of ethoxylation (standard range)
- Berol OX-91-8—$C_{9-11}$ alcohol with 8 moles of ethoxylation (standard range)
- Ethoquad C/25 MS—cocomethyl ethoxylated (15) ammonium methylsulphate
- Ethoquad® T/25—tallowmethyl ethoxylated (15) ammonium chloride
- Propoquad® C/12—cocomethyl-bis-(2-hydroxy-2-methylethyl) quaternary ammoniun methylsulphate
- Ampholak® YJH-40—a low foam hydrotrope octyliminodipropionate From Condea Vista

- Novel® II 12-4—2-butyloctanol alcohol made with 4 moles of ethoxylation (narrow range)

From Akcros Chemicals

- Versilan® MX332—proprietary blend of anionic and nonionic surfactants intended for low foam cleaning of metal parts From Harcros

- T-Det A-134—isotridecyl alcohol with 4 moles of ethoxylate (standard range)

From BASF

- Pluronic L-62—nonionic block polymer a low foam detergent for metal cleaning
- Pluronic L-64—nonionic block polymer a dispersant for metal cleaning From Union Carbide (Dow)

- Tergitol® 15-S-3—$C_{11-15}$ secondary alcohol with 3 moles of ethoxylation (standard range)
- Tergitol® 15-S-5—$C_{11-15}$ secondary alcohol with 5 moles of ethoxylation (standard range)
- Tergitol® 15-S-40—$C_{11-15}$ secondary alcohol with 40 moles of ethoxylation (standard range)

Others

- SXS—sodium xylene sulphonate a standard hydrotrope.
- EDTA—40% solution of sodium ethylenediaminetetraacetic acid
- TKPP—tetrapotassium pyrophosphate (TKPP)

EXAMPLE 1

Table 1 compares cleaning ability of the various formulations described previously with respect to cleaning ability, formulation stability and foaming properties.

TABLE 1

Summary Table of Cleaning Formulations

| | Cleaning Formula Type | | | |
|---|---|---|---|---|
| | Traditional | Low foam Nonionic | Silicon defoamer | Invention |
| Cleaning | Good-Excellent | Medium-poor | Medium-poor | Good-Excellent |
| Stability | Yes | No | No | Stable |
| Foam | Too High | Low* | Low* | Rapid collapse |

*Need to be replenished

To demonstrate the above invention, cleaning formulations with the following ingredients were prepared:

| Formulation A | |
|---|---|
| 7% | EDTA (40% solution of sodium salt) |
| 4% | TKPP |
| 2.5% | Nonionic (may be varied from 0.5 to 4%) |
| 6% | Hydrotrope (or X amount until clear and stable) |

The test formulations were diluted 1:10 with distilled water and 100 ml samples were placed into the blender. The test solutions were blended for 60 sec at 1600 rpm and decanted into a measuring cylinder. The foam volume was determined initially, then after intervals of 1 and 5 minutes. The collapse rate was determined by taking the initial foam volume and dividing it by the time in seconds that it took to reach zero foam. If foam was still present at five minutes, the final foam volume was subtracted from initial volume and divided by 300 seconds. This test method was chosen to demonstrate the stability of any foam generated by the cleaning formulation under mechanical agitation. The influence of nonionic surfactant type, hydrotrope type and variations of Berol CHLF structure on the collapse rate of the cleaning formula was studied. Also, the percentage of nonionic in the formulation was varied to determine its contribution to collapse rate.

TABLE 2

Foam Generation plus Collapse Rates for Various Nonionic and Hydrotropes

| Formulation | | Foam Volume (ml) after minute | | | Collapse Rate |
|---|---|---|---|---|---|
| Nonionic | Hydrotrope | 0 min. | 1 min. | 5 min. | (ml/sec) |
| Berol 840* | — | 0 | 0 | 0 | N/A |
| — | Berol CHLF | 200 | 86 | 0 | 1.6 |
| — | — | 40 | 12 | 4 | 0.12 |
| Berol 840 | Berol CHLF | 205 | 0 | 0 | 6 |
| Novel 112-4 | Berol CHLF | 190 | 120 | 40 | 0.5 |
| T-DET A-134 | Berol CHLF | 194 | 104 | 48 | 0.5 |
| Berol 260 | Berol CHLF | 200 | 170 | 52 | 0.5 |
| Berol 840 | SXS | 350 | 320 | 166 | 0.6 |
| Novel 112-4 | SXS | 170 | 124 | 52 | 0.4 |
| T-DET A-134 | SXS | 168 | 106 | 54 | 0.4 |

*Cloudy unstable formulation

The above results show that the Berol CHLF alone in this formulation has a collapse rate of ~1.6 ml/sec (average of five batches, values range from 1.2–2.1 ml/sec). When this hydrotrope was combined with various low foam nonionic surfactants in the majority of the cases the collapse rate drops to ~0.5 ml/sec or less. However, when Berol CHLF was combined with Berol 840 the collapse rate increased by three-fold to ~6 ml/sec (average of five batches values range from 4.7–8.7 ml/sec). However, combination of Berol 840 with a traditional hydrotope such as sodium xylene sulfonate (SXS) results in a boost of foam volume and a reduction in collapse rates, due to foam stabilization, as seen in Table 2. The other two nonionic surfactants tested show no significant change in foam stability or amount of foam generated based on hydrotrope selected.

TABLE 3

Structure Variations on Berol CHLF and Various Hydrotropes Influence on Collapse Rates with Berol 840

| Hydrotrope | Type | Collapse Rate (ml/sec) |
|---|---|---|
| Berol CHLF | 2 EO + 12 PO + 5 EO Methyl sulfate | 6 |
| Berol CHLF Type | 2 EO + 12 PO + 5 EO Chloride | 5.2 |
| Berol CHLF Type | 5 EO + 12 PO Methyl sulfate | 5.2 |
| SXS | Sodium xylene sulphonate | 0.6 |
| Ampholak YJH-40 | Amphoteric-octyliminodipropionate | 0.4 |
| Ethoquad C/25 MS | Coco quat 15 EO | 0.7 |
| Ethoquad T/25 | Tallow quat 15 EO | 0.6 |
| Propoquad C/12 | Coco quat 2 PO | 0.5 |

Adjusting the alkoxylated cationic hydrotrope structure by varying the EO/PO content or the counter ion preserves the rapid collapse rate seen with Berol CHLF and Berol 840 formulations (Table 3). Use of more traditional hydrotropes results in the decline in the collapse rate of the cleaning formulations, even when a low foam hydrotrope such as Ampholak YJH-40 was used. The above-data suggest that propoxylation in the alkoxylated group is a critical factor in foam collapse behavior.

TABLE 4

The Effect of Various Nonionics Surfactant Types on the Formulation Collapse Rates with Berol CHLF

| Alkyl type | Moles of EO | Ethoxylation Types | HLB | Collapse Rate (ml/sec) |
|---|---|---|---|---|
| 2-ethylhexyl | 4 | NR | 11.2 | 6 |
| 2-ethylhexyl | 5 | SR | 13 | 4.5 |
| 2-ethylhexyl | 2 | SR | 9 | 0.6 |
| 2-ethylhexyl | 8 | NR | 16 | 2 |
| 2-ethylhexyl | 8 | SR | 16 | 2 |
| 2-propylheptyl | 5 | NR | — | 4.3 |
| 2-Butyloctyl | 4 | NR | 10 | 0.5 |
| $C_{6-10}$ | 3.5 | SR | | 0.5 |
| $C_{8-10}$ | 4.5 | SR | 11 | 0.7 |
| $C_8$ | 4 | NR | 11.6 | 2 |
| $C_{10}$ | 4 | NR | 10.5 | 1 |
| $C_{9-11}$ | 4 | NR | 10.5 | 0.5 |
| Methyl capped $C_{8-10}$ | — | SR | — | 2 |
| Benzyl capped $C_{9-11}$ | 7 | SR | — | 2 |
| Iso tridecyl | 4 | SR | | 0.5 |
| $C_{11-15}$ (Secondary) | 3 | SR | 10.6 | 0.5 |
| $C_{11-15}$ (Secondary) | 5 | SR | 8.3 | 0.5 |

NR = narrow range ethoxylate; SR = standard (broad) range ethoxylate

Adjusting the nonionic surfactant type in the formulation indicates that two moles of EO on the 2-ethylhexanol was not sufficient to provide rapid defoaming such as seen with higher ethoxylates (Berol 840). However, the distribution of the ethoxylation, a result of process conditions, does not affect the defoaming ability of the ethoxylated 2-ethylhexyl in these formulations. This is illustrated with the 2-ethylhexyl plus 5 moles EO based formulation, which gave results similar to the Berol 840 based formulation. 2-ethylhexyl plus 5 moles EO is produced by traditional ethoxylation techniques that produce a broad distribution of EO. Berol 840 is processed under conditions that result in a narrow distribution of EO as seen in Table 4. Slightly higher Guerbet alcohol based nonionics such as 2-propylheptyl with 5 moles of EO exhibit the same behavior as 2-ethylhexyl. However, longer Guerbet alcohols like 2-butyloctyl do not behave in the same manner with the Berol CHLF in these formulations.

Higher levels of ethoxylation cause a decrease in the defoaming rate as illustrated by the use of 2-ethylhexyl plus eight mole of ethoxylate, which gives a collapse rate similar to the formulation with just the Berol CHLF. Screening results for other types of nonionics surfactants with various alkyl groups, HLBs, moles of EO and ethoxylation type can also be seen in Table 4. Branched alkyl groups other than short Guerbet alcohols do not provide the same rapid foam collapse. Linear fatty alkyl chains do not boost the collapse rate, but in general as the chain length decreases, the influence on collapse rate of the Berol CHLF decreases. Capping of the ethoxylate does not appear to affect the collapse rate, as seen with the benzyl methyl capped nonionic in Table 4.

The amount of nonionic has a dramatic impact on the collapse rate of this formulation type as can be seen in FIG. 1. As the amount of Berol 840 increases the collapse rate of the formulation increases. The collapse rate dramatically increases above 2% nonionic and it reaches a maximum between about 2.5% and 3.5% Berol 840. However, the opposite trend was seen with two other branched low foaming nonionic tested. Both Novel II 12-4 and T-Det A 134 nonionic surfactants show a decrease in collapse rate as the amount of nonionic was increased in the test formulations. The results are in Table 5.

TABLE 5

Influence of Nonionic Surfactant Level on Collapse Rates of Berol CHLF

| Nonionic Amount (%) | Foam Volume (ml) Initial | Foam Volume (ml) 5 min | Time to zero Foam | Collapse rate (ml/sec) |
|---|---|---|---|---|
| Berol 840 | | | | |
| 0.5 | 230 | 0 | 135 | 0.9 |
| 1 | 220 | 0 | 120 | 1.3 |
| 1.5 | 220 | 0 | 110 | 1.8 |
| 2 | 220 | 0 | 77 | 2.5 |
| 2.5 | 210 | 0 | 45 | 4.7 |
| 3 | 220 | 0 | 42 | 4.9 |
| 3.5 | 220 | 0 | 67 | 3.3 |
| 4 | 240 | 0 | 206 | 1.2 |
| Novel II 12-4 | | | | |
| 0.5 | 210 | 0 | 140 | 1.5 |
| 1 | 210 | 0 | 225 | 0.9 |
| 1.5 | 210 | 39 | — | 0.6 |
| 2 | 220 | 40 | — | 0.6 |
| 2.5 | 190 | 40 | — | 0.5 |
| T-Det A 134 | | | | |
| 0.5 | 210 | 0 | 245 | 0.9 |
| 1 | 210 | 30 | — | 0.6 |
| 1.5 | 210 | 48 | — | 0.5 |
| 2 | 210 | 58 | — | 0.5 |
| 2.5 | 194 | 48 | — | 0.5 |

Cleaning Performance

Test solutions of cleaning Formulation A were prepared with three nonionic surfactants with two being known degreasers as shown in Table 6. These test formulations were diluted 1:10 with distilled water and their ability to degrease a real world soil (greasy/oily soil obtained from train engines) was determined using the method described below. The results indicated that the combination of Berol CHLF with Berol 840 gives statistically similar cleaning to both Berol 260 and T-DET A-134 both of which are considered excellent degreasers.

| Formulation A: | |
|---|---|
| 7% | EDTA (40% solution of sodium salt) |
| 4% | TKPP |
| 2.5% | Nonionic surfactant |
| 6% | Berol CHLF |

TABLE 6

Cleaning ability of Formulation A with Various Nonionic Surfactants.

| Nonionic | Degreasing (%) |
|---|---|
| Berol 840 | 58 ± 11 |
| Berol 260 | 70 ± 5 |
| T-DET A-134 | 69 ± 11 |

EXAMPLE 2

Two formulations were compared using the Formulation $B_1$ and Formulation $B_2$ shown below. The foaming and cleaning ability of these two surfactant systems were compared as described previously. Formulation $B_1$ combines 3.5% Berol 840 and 6% Berol CHLF and Formulation $B_2$ contains 9.5% Versilan MX332 (Akcros) with the same builders. Versilan MX332 has been described as a low foam cleaning surfactant blend recommended for metal cleaning. Versilan MX332 low foaming character is dependent on temperature as shown in Table 7. Results indicate that the combination of Berol 840/Berol CHLF was at least eight time more effective at degreasing under non-mechanical conditions than Versilan MX332.

| Formulation $B_1$: | |
|---|---|
| 7% | EDTA (40% solution of sodium salt) |
| 4% | TKPP |
| 3.5% | Berol 840 |
| 6% | Berol CHLF |

compared with

| Formulation $B_2$: | |
|---|---|
| 7% | EDTA (40% solution of sodium salt) |
| 4% | TKPP |
| 9.5% | Versilan MX332 |

TABLE 7

Comparison of Invention Formulation with a Low Foam Formulation

| Formula | Foam Volume (ml) 0 min | 1 min | 5 min | Collapse Rate (ml/sec) | De-greasing (%) | Appear-ance |
|---|---|---|---|---|---|---|
| Berol 840/Berol CHLF | 220 | 2 | 0* | 3.3 | 50 ± 10 | Clear |
| at 130° F. | 70 | 26 | 0* | 0.3 | | Clear |
| Versilan MX332 | 134 | 66 | 40 | 0.3 | 6 ± 2 | Clear |
| at 130° F. | 130 | 25 | 18 | 0.3 | | Cloudy |

*Time to zero foam was 60 seconds and at 130° F. the time was 240 seconds.

The results also indicate that the combination of Berol 840 and Berol CHLF generate very unstable foam at low temperatures and significantly lower foam volumes at higher temperature with slightly more stable foam. The formulation containing Versilan MX332 has a small reduction in foam volume that appears to be quite stable after an initial decline. The formulation containing Versilan MX332 also shows less stability than the combination of Berol 840 and Berol CHLF.

EXAMPLE 3

Parts Cleaning Test

A formulation containing Berol CHLF was submitted to an external laboratory for testing in a "Cyclo Jet I Tumbling System."

Parts Information

Parts description: Automotive Engine and transmission parts

Material: Steel, Aluminum

Throughput per day: Various

Shifts: 8 hours

Contamination to be removed: oil, grease, dirt

Any holes ? yes

Are holes to be cleaned ? yes

Process information

Next process: Re-assemble

Loading parts into machine: Manually

Existing cleaning method: Manually

Stages Requested for Test Cleaning: Wash: Yes

Rinse: Yes

Dry: Yes

Results shown in Table 8 indicated that Berol CHLF formulations can clean soiled car parts without foam generation or leaving any streaks or film on the parts after cleaning in a "Cyclo Jet I Tumbling System".

TABLE 8

Cycle Parameters and Cleaning Results

| Test | Cycle Parameters: Wash Time (min) | Wash Temp (° F.) | Rinse Time (min) | Rinse water | Dry Time (min) | Dry Temp (° F.) |
|---|---|---|---|---|---|---|
| 1 | 3 | 170 | 2 | Fresh | 3 | 275 |
| | Results: Parts appear clean and dry | | | | | |
| 2 | 4 | 170 | 1.5 | Fresh | 3 | 250 |
| | Results: Parts appear clean and dry | | | | | |
| 3 | 8 | 160 | 1.5 | Fresh | 3 | 250 |
| | Results: Parts appear clean and dry | | | | | |

EXAMPLE 4

Test solutions of cleaning Formulation $C_1$ were prepared with several nonionic surfactants, SXS and a cationic hydrotrope. These test formulations were diluted 1:100 with distilled water and their ability to disperse particulate (Sanders-Lambert soil) was determined using the method describe below. The results indicate that unlike other hydrotropes, Berol CHLF has the ability to disperse particles and aid in the cleaning of low foam surfactants such as Berol 840.

| Formulation $C_1$: | |
|---|---|
| 4% | Sodium metasilicate |
| 6% | TKPP |
| 9% | Surfactant |

TABLE 9

Cleaning ability of Formulation $C_1$ with Various Nonionic Surfactants.

| Nonionic | Removal (%) |
|---|---|
| Berol OX-91-4 | 43 ± 6 |
| Berol OX-91-8 | 54 ± 5 |
| Berol 260 | 40 ± 10 |
| Tergitol 15-S-5 | 48 ± 8 |
| Tergitol 15-S-15 | 55 ± 8 |
| Tergitol 15-S-40 | 28 ± 7 |
| Pluronic L-62 | 27 ± 6 |
| Pluronic L-64 | 28 ± 6 |
| Hydrotrope | |
| Sodium Xylene Sulphonate | 31 ± 1 |
| Berol CHLF | 69 ± 14 |

Cleaning Test Method

Non-Mechanical Cleaning Evaluations (Black Box Test)

SCOPE:

A non-mechanical cleaning test method for dilutable Industrial Cleaners that can be used to evaluate the influence of surfactants in the cleaning solution.

DESCRIPTION:

Reagents 1.1 General Chemical

Berol 226

40% solution of Sodium Ethylenediaminetetraacetic acid (EDTA)

Tetrapotassium Pyrophosphate (TKPP)

Distilled/deionized water

Isopropyl alcohol (IPA)

Control solution

Tap water for rinsing

Soils

Urban Lambert soil (sources of reagents are describe below)

1.2 Control Solution

Berol 226 Standard Formulation D:

| | |
|---|---|
| Berol 226 | 9% |
| EDTA (40%) | 9% |
| TKPP | 4% |
| Water | 78% |

1.3 Soils 1.3.1 Real World Soils

Soils obtained from train engines in Europe and the US.

1.3.2 Synthetic Soil

| Soil Formulation: | |
|---|---|
| Sander-Lambert Soil (particulate mix) | 16 g |
| Non detergent motor oil | 7 g |
| Isopropyl alcohol | 200 g |

The Sander-Lambert soil particulate mix contains the following ingredients: Hyperhumus 38%, Portland cement 15%, low-furnace carbon black 1.5%, synthetic red iron pigment 0.3%, powdered silica 200–300 mesh 15%, bandy black clay 16.7%, stearic acid 1.5%, oleic acid 1.5%, palm oil 3%, cholesterol 1%, vegetable oil 1%, octadecene 2% linolecic acid 2% and mineral oil 1.5%. This particulate mix can either be prepared in house as follows or ordered pre-made from SGS U.S. Testing Company Inc, Fairfield, N.J. The above components are mixed together and transferred to a ball mill, then mixed for 18 hours using both large (1.25 inch diameter by 1.25 inch) and small (0.5 inch diameter by 0.5 inch) ceramic cylinders. The soil is transferred by a shallow pan and allowed to air-dry. Once the soil is completely dry it is pulverized and passed through a 300 mesh screen.

Equipment 1. 100 ml and 25 ml Pyrex beakers
2. Spectrophotometer or reflectometer (any instrument capable of accurately measuring changes in substrates reflectance, such as Minolta CM-508D spectrophotometer)
3. 1 inch paint brush
4. Aerosol sprayer
5. Sink with a water spray nozzle
6. 1×140×220 mm steel plates, which were primed, painted (white) plus two coats of lacquer, not unlike a car surface.

Procedures

1. The panels are washed with detergent, then cleaned with IPA and allowed to dry before use.
2. The spectrophotometer is placed on the marked sections and a base reading is taken (marked as $\Delta L_B$, $\Delta a_B$ or $\Delta b_B$—the base reading).
3. If required the synthetic soil is prepared as stated above or a real World soil sample is selected for the test.
4. The real World soil is applied on to the test panel with a brush, then the soil is smoothed over the surface to obtain an even coating as possible using a Kimwipe. If using, the Synthetic soil, the soil is sprayed across the test panel once using an aerosol sprayer, once the IPA has evaporated off the surface a second coat is applied. The plates are then allowed to stand for 12 hour before testing.
5. The spectrophotometer is placed on the marked sections of the soiled panels and the soiled reading is taken (marked as $\Delta L_S$, $\Delta a_S$ or $\Delta b_S$—the soiled reading).
6. 100 mls of the test solutions are prepared and the solution is diluted between 1:10 to 1:120 with distilled/deionized water.

7. Twenty ml of each diluted test cleaner is poured onto the soiled plate (three solutions per plate). On each test plate twenty mls of the control solution at 1:10 dilution is tested and used as a reference for product/plate performance.
8. The test solution is left for twenty seconds. The plates are then cleaned using a low-pressure water spray. The plates are cleaned from the bottom up to remove the emulsified dirt.
9. The panels are allowed to air dry. The spectrophotometer is placed on the marked sections and the final reading is taken (marked as $\Delta L_C$, $\Delta a_C$ or $\Delta b_C$—the cleaned reading).
10. The Delta values are used to calculated the amount of soil removed from the panel using the C.I.E. Lab or L*a*b Color Space standard.

$$\Delta E_1=\sqrt{(\Delta L_{S-\Delta L_B})^2}+(\Delta a_S-\Delta a_B)^2+(\Delta b_S-\Delta b_B)^2$$

$$\Delta E_2=\sqrt{(\Delta L_{C-\Delta L_B})^2}+(\Delta a_C-\Delta a_B)^2+(\Delta b_C-\Delta b_B)^2$$

$\Delta E_1$ is the color difference between the base reading and soiled reading. $\Delta E_2$ is the color difference between the base reading and the cleaned reading Percentage of soil removal is calculated as the difference between $\Delta E_2$ and $\Delta E_1$ as shown below:

$$\text{Soil Removal}(\%)=((\Delta E_1-\Delta E_2)/\Delta E_1))\times 100$$

11. Each formulation was then tested at three times and the standard deviation calculated. However, if the standard deviation of a single test is greater than 15%, the formulation is re-tested and any outlying points eliminated. In some cases the repeated studies show no outlying points and both data sets are combined. The control solution should give 95±7% soil removal.

We claim:

1. A low foaming cleaning formulation which comprises at least one hydrotropic alkoxylated quaternary ammonium compound in combination with at least one nonionic surfactant based on ethoxylated short chain branched alcohols, wherein said hydrotropic alkoxylated quaternary ammonium compound is of formula II

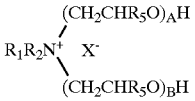

(II)

wherein $R_1$ is linear or branched, saturated or unsaturated $C_6$–$C_{22}$ alkyl group;

$R_2$ is $C_1$–$C_6$ alkyl group;

$X^-$ is an anion, each $R_5$ is independently at each occurrence $C_1$–$C_2$ alkyl or H provided that at least occurrence of $R_5$ is a $C_1$–$C_2$ alkyl; and A and B are integers greater than or equal to 1 wherein A+B is 2–50, and said nonionic surfactant is of formula III $$R—O—(CH_2CH_2O)_nH \qquad \text{III}$$

wherein R is a branched alkyl group having 3–12 carbon atoms and n=3–12.

2. The formulation of claim 1 wherein said nonionic surfactant has an average of 3–12 moles of ethoxylation with either narrow or broad range distribution.

3. The formulation of claim 1 wherein R is derived from a Guerbet alcohol having up to 12 carbon atoms, and wherein the ethoxylation of said nonionic surfactant has either narrow or broad range distribution.

4. The formulation of claim 1 wherein said nonionic surfactant is selected from the group consisting of polyoxyethylene (3) 2-ethylhexanol, polyethyleneglycol-4 ethylhexyl ether, polyethyleneglycol-5 ethylhexanol, polyoxyethylene (4) 2-ethylheptyl, polyoxyethylene (5) isodecanol, polyoxyethylene (5) 2-propylheptanol and mixtures thereof.

5. The formulation of claim 3 wherein $X^-$ is selected from the group consisting of chloride, methyl sulfate, bromide, iodide, acetate and carbonate.

6. The formulation of claim 1 wherein said hydrotropic alkoxylated quaternary ammonium compound is of the formula:

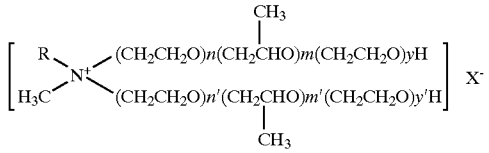

where R is a linear or branched, saturated or unsaturated $C_{12}$–$C_{22}$ alkyl, n+n'=0–10, m+m'=1–20, y+y'=1–20, and $X^-$ is an anion, provided that when n+n'=0, the y+y' is at least 1.

7. The formulation of claim 6 wherein $X^-$ is chloride or methyl sulfate.

8. The formulation of claim 6 wherein R is tallow alkyl, n+n'=2, m+m'=12, y+y'=5 and X is methyl sulfate.

9. The formulation of claim 1 wherein said hydrotropic alkoxylated quaternary ammonium compound is selected from the group consisting essentially of bis(hydroxyethyl) methyltallow alkyl, ethoxylated, propoxylated, methyl sulphate; cocobis(2-hydroxyalkyl)methylammonium chloride; polyoxyalkylene (15) cocomethylammonium chloride; oleylbis(2-hydroxyalkyl)methyl ammonium chloride; polyoxyalkylene (15) stearylmethyl ammonium chloride; N,N-bis(2-hydroxyalkyl)-N-methyloctadecanaminium chloride; N-tallowalkyl-N,N'-dimethyl -N-N'-polyalkyleneglycol -propylenebis-ammonium-bis methylsulphate; polyoxyalkylene (3) tallow propylenedimonium dimethylsulphate; coconut penta-alkoxy methyl ammonium methyl sulphate; polyoxyalkylene (15) cocomonium methosulphate; isodecylpropyl dihydroxyalkyl methyl ammonium chloride; isotridecylpropyl dihydroxyalkyl methyl ammoniun chloride; methyl dihydroxyalkyl isoarachidaloxypropyl ammonium chloride; and mixtures thereof.

10. A method of cleaning a hard surface which comprises applying to said surface a cleaning effective amount of a low foaming cleaning formulation which comprises at least one hydrotropic alkoxylated quaternary ammonium compound of formula II

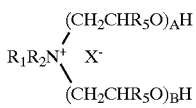

(II)

wherein $R_1$ is linear or branched, saturated or unsaturated $C_6$–$C_{22}$ alkyl group;

$R_2$ is $C_1$–$C_6$ alkyl group; and $X^-$ is an anion;

each $R_5$ is independently at each occurrence $C_1$–$C_2$ alkyl or H provided that at least one occurrence of $R_5$ is a $C_1$–$C_2$ alkyl; and A and B are integers greater than or equal to 1 wherein A+B is 2–50 in combination with at least one nonionic surfactant based on branched alcohols of formula III $$R—O—(CH_2CH_2O)_nH \quad \text{III}$$

wherein R is a branched alkyl group having 3–12 carbon atoms and n=3–12, and thereafter removing said cleaning formulation from said surface.

11. The method of claim 10 wherein said nonionic surfactant has an average of 3–6 moles of ethoxylation with either narrow or broad range distribution.

12. The method of claim 10 wherein R is derived from a Guerbet alcohol having up to 12 carbon atoms, and wherein the ethoxylation of said nonionic surfactant has either narrow or broad range distribution.

13. The method of claim 12 wherein said nonionic surfactant is selected from the group consisting of polyoxyethylene (3) 2-ethylhexanol, polyethyleneglycol-4 ethylhexyl ether, polyethyleneglycol-5 ethylhexanol, polyoxyethylene (4) 2-ethylheptyl, polyoxyethylene (5) isodecanol, polyoxyethylene (5) 2-propylheptanol and mixtures thereof.

14. The method of claim 10 wherein $X^-$ is selected from the group consisting of chloride, methyl sulfate, bromide, iodide, acetate and carbonate.

15. The method of claim 10 wherein said hydrotropic alkoxylated quaternary ammonium compound is of the formula:

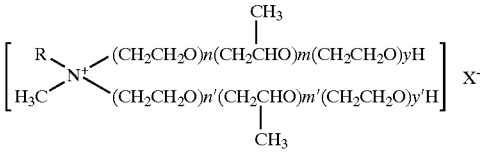

where R is a linear or branched, saturated or unsaturated $C_{12}$–$C_{22}$ alkyl, n+n'=0–10, m+m'=1–20, y+y'=1–20, and $X^-$ is an anion, provided that when n+n'=0, then y+y' is at least 1.

16. The method of claim 15 wherein $X^-$ is chloride or methyl sulfate.

17. The method of claim 10 wherein R is tallow alkyl, n+n'2, m+m'=12, y+y'=5 and X is methyl sulfate.

18. A low foaming cleaning formulation which comprises at least one hydrotropic alkoxylated quaternary ammonium compound in combination with at least one nonionic surfactant based on short chain branched alcohols, wherein said hydrotropic alkoxylated quaternary ammonium compound is selected from the group consisting essentially of bis (hydroxyethyl)methyltallow alkyl, ethoxylated, propoxylated, methyl sulphate; cocobis(2-hydroxyalkyl) methylammonium chloride; polyoxyalkylene (15) cocomethylammonium chloride; oleylbis(2-hydroxyalkyl)methyl ammonium chloride; polyoxyalkylene (15) stearylmethyl ammonium chloride; N,N-bis(2-hydroxyalkyl)-N-methyloctadecanaminium chloride; N-tallowalkyl-N,N'-dimethyl-N-N'-polyalkyleneglycol-propylenebis-ammonium-bis methylsulphate; polyoxyalkylene (3) tallow propylenedimonium dimethylsulphate; coconut pentaalkoxy methyl ammonium methyl sulphate; polyoxyalkylene (15) cocomonium methosulphate; isodecylpropyl dihydroxyalkyl methyl ammonium chloride; isotridecylpropyl dihydroxyalkyl methyl ammonium chloride; methyl dihydroxyalkyl isoarachidaloxypropyl ammonium chloride; and mixtures thereof.

19. The formulation of claim 1 which comprises from about 0.1% to about 12% by weight nonionic surfactant and from about 1% to about 20% by weight alkoxylated quaternary ammonium compound.

20. The formulation of claim 19 which comprises from about 2% to about 4% by weight nonionic surfactant and from about 4% to about 8% by weight alkoxylated quaternary ammonium compound.

21. The formulation of claim 1 wherein n is an integer of from 3–6.

22. The method of claim 10 wherein n is an integer of from 3–6.

* * * * *